United States Patent [19]

Beecroft

[11] Patent Number: 4,844,186

[45] Date of Patent: Jul. 4, 1989

[54] REPLACEABLE WELL DRILL BIT

[76] Inventor: Daniel J. Beecroft, Rte. 2, Box 139, Frederic, Wis. 54837

[21] Appl. No.: 215,378

[22] Filed: Jul. 5, 1988

[51] Int. Cl.[4] ..... E21B 10/40

[52] U.S. Cl. ..... 175/414; 175/416

[58] Field of Search ..... 175/396, 400, 401, 402, 175/403, 414, 416, 417, 795

[56] References Cited

U.S. PATENT DOCUMENTS

| | | | |
|---|---|---|---|
| 1,551,717 | 9/1925 | Watson | 175/414 |
| 1,561,580 | 11/1925 | Watson | 175/414 |
| 1,580,254 | 4/1926 | Karns | 175/414 X |
| 2,096,132 | 10/1937 | Pearce | 175/411 X |
| 3,589,456 | 6/1971 | McKain | 175/414 |
| 4,078,621 | 3/1978 | Dewar et al. | 175/409 X |

*Primary Examiner*—Jerome W. Massie
*Assistant Examiner*—David J. Bagnell
*Attorney, Agent, or Firm*—Douglas L. Tschida

[57] ABSTRACT

A replaceable bit for cable drill tool stems including a leading longitudinal cutting rib and first and second lagging, flattened reaming portions. The cutting rib diametrically extends between and bisects the reaming portions which partially extend about the bit's circumference and progressively taper upward from a wedged horizontal cutting edge. Inwardly flared channels mating with reliefs in the drill stem are defined by the inner bit surfaces on each side of the cutting edge. Beveled top edges converge to a flat welding surface mating with a prepared drill stem. A method of replacing a worn bit on a drill bit stem with such a replaceable bit is also disclosed.

15 Claims, 4 Drawing Sheets

REPLACEABLE WELL DRILL BIT

BACKGROUND OF THE INVENTION

The present invention relates to water well drilling apparatus and, in particular, to an improved cutting head for replaceable mounting to a drill stem of a cable tool type drilling rig. A hardened, wedged cutting surface and outer, flattened arcuate reaming surfaces tapering upward about the bit's circumference from the cutting edge displace the soil/rock slurry to channels in the drill stem. A non-hardened upper end facilitates replacement welding to a prepared drill stem.

Drilling in the earth can be effectuated with a variety of equipment, the selection of which depends upon a variety of factors from the types of soil to the required hole size to the bore depth, to name a few of the variables. Most prevalent of all types of well drilling activity is that undertaken in search of water, where wells may have to be sunk from a few feet to thousands of feet. Most typically though the average well for residential and light commercial use consists of a well 4 to 6 inches in diameter sunk to a depth of 100 to 500 feet.

Two of the primary drilling methodologies historically used to sink such wells operate either on a continuous rotary or a repetitive-driving principle. The latter methodology generally employs a gantry tower which supports a plurality of pulleys and about which is trained a suitable length of cable. Suspended from the lowermost end of the cable is a weighted drive head which is used to drive a bore hole pipe liner and/or an elongated drill stem and to a lower end of which is mounted a suitable cutting tip or bit. The latter apparatus is commonly referred to as a cable tool drilling rig and U.S. Pat. No. 2,833,120 generally discloses one such rig.

Such apparatus when used for boring, generally operates to repetitively lift the drill stem to an upper extreme and from which the stem is allowed to free fall to strike the ground causing a cutting action at the tip. Inherent twist in the cable also causes the cutting tip to rotate slightly as it is driven into the soil. Repetitive drill action pulverizes the soil/rock to form a slurry which is vented from the bore hole via longitudinal reliefs let in the drill stem wall. The slurry is partially removed during drilling as the drill stem is periodically raised but otherwise partially lubricates the ongoing process.

Depending again upon the type of soil conditions, the rate at which the soil is drilled will vary. Although a variety of differently configured drill tips may be used, depending on the drilling conditions, ever changing soil conditions over the course of a single bore hole may mean multiple, time-consuming tip changes which are preferably to be avoided. An all-purpose drill tip is accordingly desired which facilitates drilling through soft, hard and rocky soils.

To the extent Applicant is aware of drill tip constructions, U.S. Pat. Nos. 50,949 and 2,927,773 disclose two types of porous, shallow well drill tips of a conical construction. These latter tips are typically sunk with the casing, which is driven much in the fashion of a fence post, and are intended to remain buried in the soil.

Applicant is also aware of a pair of wedge-shaped, rock shattering tips which are disclosed in U.S. Pat. Nos. 2,136,596 and 3,403,443. Again, the latter tips are intended more for shattering hard formations. Other tip constructions intended for similar uses are shown in U.S. Pat. No. 3,194,328 and wherein a number of tips including intersecting wedged cutting edges are disclosed which generally provide for four cutting surfaces which radiate from the center of the tip, when viewed end-on.

Applicant is also aware of a number of circular-shaped tips and drill stems which surround a annular center bore wherethrough the pulverized slurry is directed upwardly. These latter tips may be found upon directing attention to U.S. Pat. Nos. 1,647,239; 3,015,365; 3,280,925; and 3,837,414. Various of the latter tips also include one or more V-shaped teeth which extend from the annular periphery of the tip.

Depending too upon the tip construction and its mounting to the drill stem, it may be necessary to periodically re-sharpen the tip which effort may be rather time consuming or require special equipment, depending upon the tip's geometric shape. In some instances the tip may have to be re-forged completely, for example via hard surface welding/grinding techniques. Otherwise, where the tip is threadably coupled to the drill stem, the tip may be periodically replaced with sharpened bits which are sharpened during slack time. Preferably therefore, a tip is described hereinafter which in lieu of a threaded mounting might be cut from the drill stem with a replacement rewelded to the stem at the job site, all in a matter of minutes.

SUMMARY OF THE INVENTION

It is accordingly an object of the present invention to provide a replaceable bit for drill stems which is relatively simple in design and which is inexpensive to use and replace.

It is another object of the invention to construct such a replaceable bit which may be replaced by a quick and easy method which eliminates the necessity of either unscrewing bits from or of forging new bits on the end of a drill string or stem.

It is a further object of the invention to provide a tip with a case hardened cutting edge and a softer, welding surface for mounting to the drill stem.

It is a yet further object of the invention to provide a tip which includes cutting and reaming surfaces while further providing one or more channelways for directing pulverized matter upward to channelways formed in the drill stem.

These and other objects are accomplished by providing a cost replaceable bit for drill stems comprising a vertically extending longitudinal cutting rib having a hardened, wedged cutting edge bisecting first and second arcuate, flattened, upwardly tapering reaming/pulverizing surfaces at opposite ends of the cutting edge. The reaming surfaces extend incompletely around the cutting rib and are displaced from one another to form longitudinal slots and channelways, relative to the cutting rib, aligning with the reliefs cut in the drill stem. The walls of the bit project upward to a peripheral bevel surrounding a non-hardened, flat apex whereat the bit is welded to a bit stem.

Replacement of a worn bit is accomplished by cutting a worn bit off the lower end of a drill bit stem, grinding the end of the stem flat and square and welding the replacement bit onto the prepared end.

The foregoing objects, advantages and distinctions of the invention, among others, as well as its detailed construction will become more apparent from the following description with respect to the accompanying drawings. Before referring thereto, it is to be appreciated the description is made by way of the presently preferred embodiment only and various alternative embodiments an modifications thereto. The invention should accordingly be interpreted within the spirit and scope of the following claims.

DESCRIPTION OF THE PREFERRED EMBODIMENT

Figure 1:
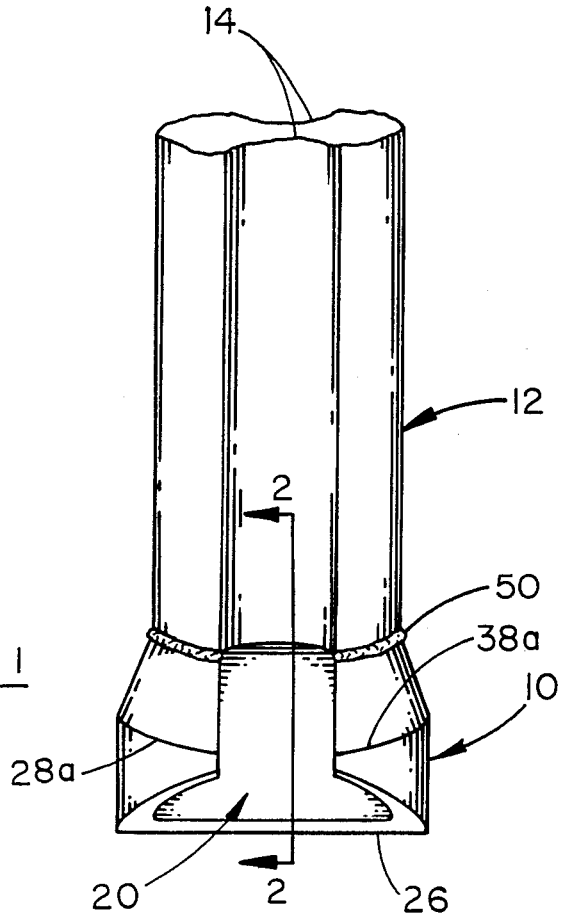
FIG. 1 shows an isometric view of the replaceable bit of the invention welded to a known drill stem.
Figure 2:
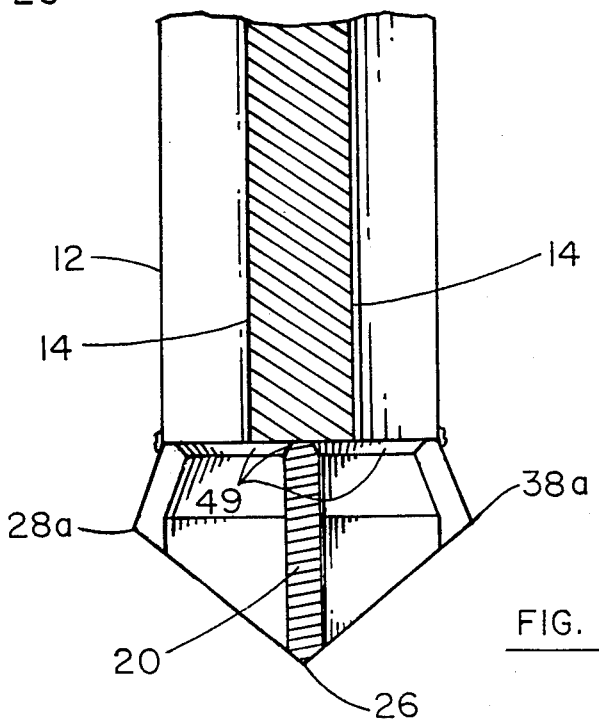
FIG. 2 shows a cross section view taken along section lines 2—2 of FIG. 1.
Figure 3:
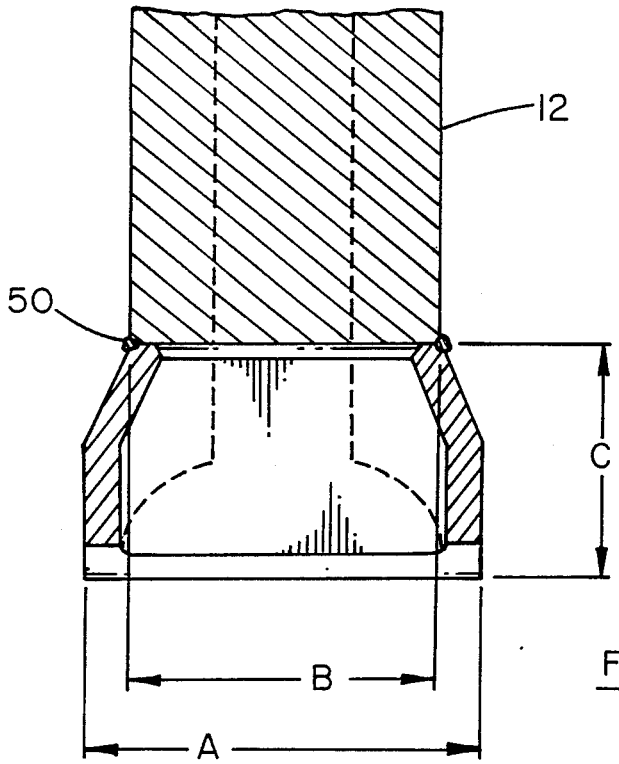
FIG. 3 shows a cross section view taken along section lines 3—3 of FIG. 4.

Referring to the drawings and FIG. 1, the novel, replaceable drill bit 10 of this invention is shown in welded relation to the lower end of a known, conventional drill stem 12. Drill stem 12 as illustrated has a pair of concave longitudinally extending flutings or reliefs 14 whereby soil and water may exit the bore hole as the drill bit 10 and stem 12 are repeatedly driven into the soil.

The specific construction of the presently preferred bit 10 is best illustrated in FIGS. 2 through 5. The bit 10 is preferably formed from a single piece of cast metal, suitably hardened as described below, and includes a longitudinal rib 20 which extends vertically from the top 22 to the bottom 24 of the bit 10. The rib 20 diametrically extends across the width of the bit and provides for a horizontal wedged cutting edge 26 over its entire width. One side of the rib 20 terminates in a first arcuate or concave curved wall 28 having a pair of wall portions 30 and 32 bisected by the rib 20. The opposite end of the rib 20 terminates in a second curved, concave arcuate wall 34 formed by a second pair of bisected wall portions 36 and 38. In combination, the walls 28 and 34 and flattened bottom reaming/pulverizing surfaces 29 and 35 exhibit a discontinuous-circular outer shape, when viewed end-on (reference FIG. 4).

Each of the wall portions 28 and 34 is preferably integrally formed with the rib 20. As is apparent from FIGS. 1, 3 and 5, the outer walls 28 and 34 rise vertically to ledges 28*a* and 34*a* before tapering inward toward the top 22. The reaming surfaces 29 and 35, in turn, flare or taper upward as they extend laterally from the rib 20. Thus, the cutting edge 26 strikes the soil before the reaming/pulverizing surfaces 29, 35, which surfaces 29 and 35 follow and reduce the particulate size of the cut soil/rock and direct it upward and inward as a slurry into the stem reliefs 14. The width A of the bit 10 at the cutting edge 26 is also greater than the diameter B at the drill stem 12, which accounts for the taper at the ledges 28*a* and 34*a* and provides additional free space for the slurry.

Figure 4:
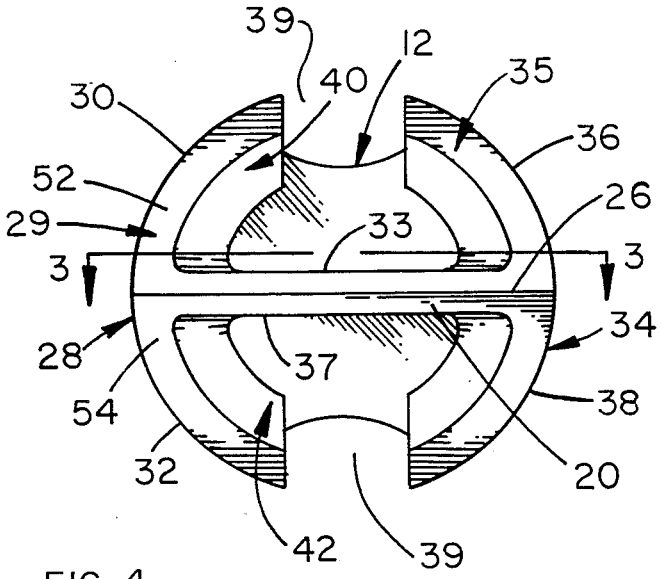
FIG. 4 shows a bottom plan view of the replaceable bit of FIG. 1.

As is apparent from FIG. 4, the walls 28 and 34 also extend incompletely around the circumference of drill bit 10 such that gaps 39 are present between ends of the wall portions 30, 36 and 32, 38. A pair of continuous inner bit surfaces 40 and 42 are, in turn, defined by the inner surfaces of the wall portions 30, 36 and 32, 38 and the respective inner side faces 33, 37 of the rib 20. The inner surfaces 40, 42 neck down to generally align with the reliefs 14.

Figure 5:
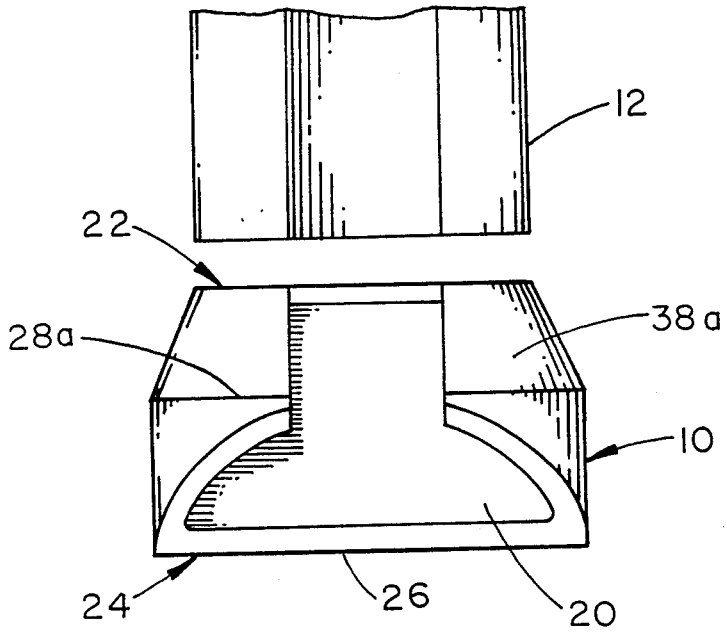
FIG. 5 show an isometric view of the replaceable bit of FIG. 1 prior to its being welded to the drill stem.

As illustrated in FIG. 5, the top 22 of the bit 10 presents a planar or flat surface so that it can be easily welded as at 50 to the squared end of a prepared drill stem 12. The inner surfaces 49 of bit 10 (reference FIG. 2) adjacent the top 22 and the drill stem 12 are preferably also beveled slightly to improve heat transfer and weld penetration.

The horizontal cutting edge 26 of the bit 10 is particularly formed by the bevel surfaces 52 and 54 which coverage towards one another until they intersect at the edge 26. At present, the cutting edge is case hardened to a Rockwell hardness of 63 to a depth of 0.060 inches. This has proved adequate on average to permit drilling 400 to 500 feet of bore hole between bit changes, in contrast to previous bits from which only 300 to 350 feet could be obtained, for the same soil conditions. Moreover, the present bit cuts at up to a 50% faster rate which is believed to occur due to the improved tip design and hardened construction.

The replaceable drill bit 10 may be cast from many different metals or metal alloys for different drilling applications and could, for example, be cast iron. It might also be hardened to different hardnesses or depths of hardness. The present bit 10 is particularly cast from an 8620 alloy and is, again, hardened to a 63 Rockwell rating to a depth of 0.060 inches.

For one embodiment of the invention, the dimension A is approximately 31 5/16 inches, B is approximately 3 inches, and C is approximately $2\frac{1}{2}$ inches. The sides of a bit having these dimensions and the widths of the surfaces 29 and 35 are approximately $\frac{3}{8}$ inches thick. Otherwise, for langer drill bits capable of boring holes 6 to 10 inches in diameter, the dimensions of the bit 10 will have to be increased proportionately, along with the size of the drill stem 12 and drive head weight.

In operation drill bit 10 and drill stem 12 can be driven into the ground by any conventional impact method. Conventional rotary hydraulic or pneumatic hammering means conceivably could be used. Preferably and for cable tool drilling, however, a weighted drive string, including the drill stem 12 and bit 10, is repeatedly lifted by a cable (not shown) and dropped, which cuts/pulverizes a bore hole through the soil.

As the bit 10 is driven, the cutting edge 26 repeatedly strikes the bottom of the bore hole to penetrate and pulverize the soil into a slurry which is directed by the inner vent surfaces 42 and 44 to the reliefs 14 of the stem 12 and upward out of the bore hole. The bit 10 is thus able to more easily penetrate the soil. The gaps 39 additionally provide the drill bit 10 with less resistance to ground penetration, since some of the ground, which has been dislodged and displaced by cutting edge 26, can pass through gaps 39.

As the bit 10 is driven, the flattened surfaces 29 and 35 of the wall portions 30, 32 and 36, 38 provide the pulverizing action for the soil cut by the edge 26. A twisting action induced in the bit 10 by way of the cable produces a reaming action as the bit/stem is raised/lowered. The pulverized slurry is thus raised free of the hole bottom or sufficiently so as not to hamper the drilling action.

As additionally noted above, the bit 10 is welded onto the squared end of drill bit stem 12. The bit 10 is particularly designed to eliminate having to forge bits from the end of the drill stem 12 or of performing hard surface welding/grinding to form the bit shape, which have heretofor been the typical practice. Instead, now the bit 10 may be is dressed or sharpened several times by grinding during slack times.

When after a period of use, sharpening becomes impractical or impossible, the bit 10 is cut off the drill stem 12 with a suitable saw or cutting torch. The end of the stem 12 is ground square, and a new replacement bit 10 is welded onto the stem. The process requires no more than twenty to thirty minutes to complete, as compared with the hours typically required to forge bits onto the end of the drill stem 12. Bit replacement is also easily performed at the job site and thus a well driller need only maintain a collection of spare sharpened bits, with the dull bits being re-sharpened during slack hours.

Figure 6:
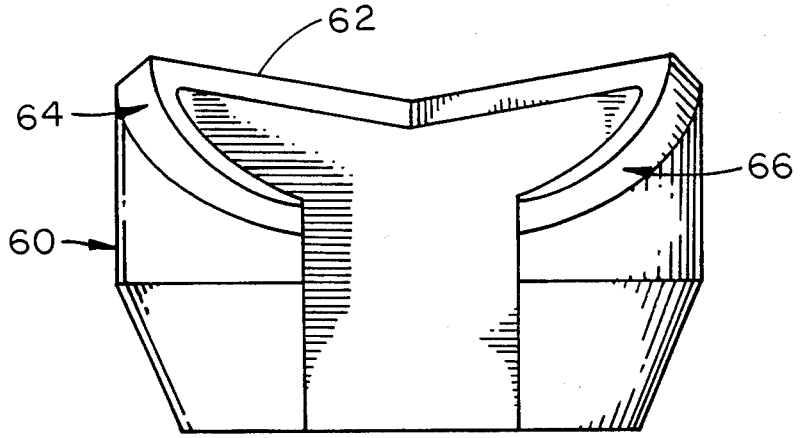
FIG. 6 shows an isometric view of an alternative embodiment of the invention with multiple cutting edges.

FIG. 6 shows an alternative embodiment of the invention and wherein a bit 60 is generally constructed to a similar shape as the bit 10. A shallow tapered V-shaped cutting edge 62 is however now provided. Also, instead of providing flat reaming surfaces 29 and 35, the wedge of the cutting edge 62 is carried over to each reaming surface 64 and 66 which edges facilitate cutting. Alternatively, alternating halves of each of the reaming surfaces 64, 66 on opposite sides of the rib may be flat.

Figure 7:
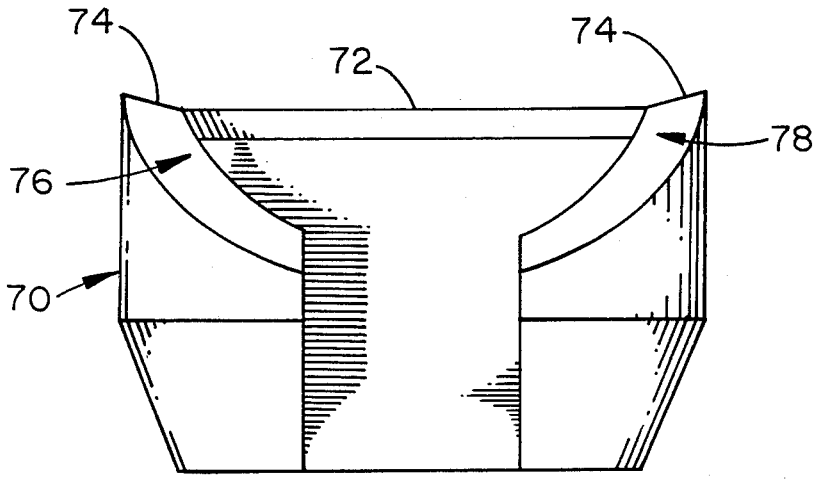
FIG. 7 shows another alternative bit and primary cutting edge.

Otherwise, referring lastly to FIG. 7, yet another alternative drill bit 70 is shown wherein the cutting edge 72 extends horizontally over most of its length, except at its outer ends 74 which taper upward over the reaming surfaces 76 and 78. An inwardly directed chipping action is thereby achievable at the outer extreme of the cutting edge 72, but which may result in greater wear at the outer edge portions edge and premature bit failure. Offsetting advantages in rocky soil are otherwise believed possible with this latter bit.

Although a presently preferred and various alternative embodiments of the invention have been described, it is to be appreciated still others are possible. The foregoing description should therefore not be interpreted literally to the noted specifics and the exclusion of such other possible embodiments. Rather, the foregoing description should be understood to infer that the invention is capable of modification without departure from the spirit and scope of the appended claims.

What is claimed is:

1. A replaceable drive bit comprising:

(a) a planar vertically extending rib portion having a beveled lowermost surface defining a horizontal cutting edge;

(b) first and second integral wall portions arcuately projecting in tangential, partial vertical circumscribing relation to said rib portion from respective opposite lateral side edges of said rib portion, wherein each of the arcuate wall portions exhibit an inner surface which relative to a vertical front and rear surface of said rib portion define first and second vertical channelways through said bit and wherein a lowermost surface of each wall portion progressively spirals upward as it projects from the rib portion.

2. Apparatus as defined by claim 1, wherein said first and second walls extend incompletely around said bit so that gaps are present between adjacent ends of said first and second walls.

3. Apparatus as defined by claim 1 wherein the cutting edge is formed by a pair of bevel surfaces which converge to intersect at and form the cutting edge.

4. Apparatus as defined by claim 3 wherein the cutting edge extends horizontally over substantially the entire width of said rib.

5. Apparatus as defined by claim 3 wherein the cutting edge of said bit is hardened to a relative hardness greater than the remainder of said bit.

6. Apparatus as defined by claim 1 wherein said rib bisects said first and second walls.

7. Apparatus as defined by claim 1 wherein an upper end of said rib and said first and second wall portions are co-planar flat.

8. Apparatus as defined by claim 7 wherein the peripheral edges of said bit in the region of the upper end bevel inward from said first and second longitudinal channelways.

9. Apparatus as set forth in claim 1 wherein when viewed end-on the outer surface of the first and second wall portions exhibit a substantially circular outline.

10. Apparatus as set forth in claim 1 wherein a lower portion of the outer surface of the first and second wall portions are circular and an upper portion conically tapers inward to align with a drill stem secured to the bit.

11. Apparatus as set forth in claim 1 wherein the inner surface of the first and second wall portions conically narrows from the bottom to the top of the bit.

12. Apparatus as set forth in claim 1 wherein said cutting edge includes a plurality of regions which integrally horizontally extend from one another.

13. Apparatus as set forth in claim 1 wherein the lowermost surface of each wall portion comprises a plurality of converging beveled surface portions.

14. Percussion drilling apparatus comprising:

(a) a drive bit having (i) a planar vertically extending rib portion including intersecting bevel surfaces converging to define a lowermost horizontal cutting edge that uninterruptedly extends the substantial width of the bit and (ii) first and second integral wall portions bisected by and projecting in tangential vertical circumscribing relation to said rib portion from respective lateral side edges of said rib portion, wherein the wall portions project incompletely around said bit such that gaps are defined between adjacent ends of the wall portions, wherein each of the wall portions exhibit a continuous outer surface over the height of said bit and further exhibit an inner surface which relative to vertical front and rear surfaces of said rib portion define first and second vertical channelways having a relatively larger lower ingress opening than an upper egress opening through said bit and wherein a lowermost surface of each of the arcuate wall portions is horizontally flat and progressively spirals upward as it projects from the rib portions; and (b) a drive member secured to said drive bit and having vertically extending channelways aligned with said egress openings.

15. A replaceable drive bit comprising:

(a) a planar vertically extending rib portion having a pair of intersecting beveled lowermost surfaces converging to a define horizontal cutting edge that diametrically extends the width of the bit;

(b) first and second integral wall portions bisected by and circularly projecting in tangential, partial vertical circumscribing relation to said rib portion from respective opposite lateral side edges of said rib portion, wherein each of the wall portions exhibit a continuous outer surface over the height of said bit and further exhibit a conically narrowing inner surface which relative to front and rear surfaces of said rib portion define first and second vertical channelways through said bit and wherein a lowermost surface of each of the arcuate wall portions on opposite sides of the rib portion are horizontally flat and progressively spiral upward at substantially the same incline as the beveled surfaces defining the cutting edge.

* * * * *